US005797580A

United States Patent [19]

Ryberg

[11] Patent Number: 5,797,580

[45] Date of Patent: Aug. 25, 1998

[54] STAND FOR SUPPORTING A CUT TREE TRUNK

[76] Inventor: Roben Ryberg, 5500 Huntington Pky., Bethesda, Md. 20814

[21] Appl. No.: 706,895

[22] Filed: Sep. 3, 1996

[51] Int. Cl.[6] ..... A47G 7/02

[52] U.S. Cl. ..... 248/523; 269/228; 269/96; 47/40.5

[58] Field of Search ..... 248/523; 47/40.5; 81/421; 269/2, 96, 99, 188, 201, 205, 228

[56] References Cited

U.S. PATENT DOCUMENTS

| | | | |
|---|---|---|---|
| 535,887 | 3/1895 | Brown | 248/523 |
| 1,306,426 | 6/1919 | Graves | 269/228 X |
| 1,662,579 | 3/1928 | Kirshner . | |
| 2,103,074 | 12/1937 | Gardner | 269/228 X |
| 2,524,450 | 10/1950 | Knaus | 248/523 |
| 2,628,798 | 2/1953 | Kass et al. | 47/40.5 X |
| 2,869,812 | 1/1959 | Hamel . | |
| 2,871,812 | 2/1959 | Pederson | 269/201 X |
| 3,295,802 | 1/1967 | Leatherman . | |
| 3,514,091 | 5/1970 | Johnson et al. | 269/228 X |
| 3,585,704 | 6/1971 | Schroeder | 269/2 X |
| 3,718,327 | 2/1973 | Nunez | 269/96 X |
| 3,787,015 | 1/1974 | Ablett . | |
| 4,088,294 | 5/1978 | Aliment et al. . | |
| 4,305,575 | 12/1981 | Bardes | 269/228 X |
| 4,611,781 | 9/1986 | Wiegand . | |
| 4,778,140 | 10/1988 | Karlewski . | |
| 4,968,011 | 11/1990 | Womack | 269/96 X |
| 4,989,820 | 2/1991 | Sterling . | |
| 5,058,869 | 10/1991 | Ruthven | 269/228 X |
| 5,337,990 | 8/1994 | Brown . | |
| 5,351,585 | 10/1994 | Leseberg et al. . | |
| 5,375,808 | 12/1994 | Roy . | |
| 5,407,168 | 4/1995 | Shultz . | |
| 5,467,959 | 11/1995 | Behringer . | |
| 5,490,350 | 2/1996 | Eisenschenk et al. | 248/523 X |

FOREIGN PATENT DOCUMENTS

| | | | |
|---|---|---|---|
| 528613 | 7/1931 | Germany | 269/201 |

*Primary Examiner*—Peter M. Cuomo
*Assistant Examiner*—David E. Allred
*Attorney, Agent, or Firm*—Birch, Stewart, Kolasch & Birch, LLP

[57] ABSTRACT

A stand for supporting a cut tree trunk in a vertical position includes a tree trunk encircling clamp, having a first curvate locking jaw and a second curvate locking jaw each having a free end and a base end. The base ends are pivotally connected to each other at a base. The locking jaws include a serrated inner surface convexly curved in a radially inward direction facing each other for closure with a tree trunk. A locking clamp includes a rigid handle fixedly secured to the base end of the first locking jaw and a pivoting handle pivotally secured to the second pivoted jaw adjacent the base end of the rigid handle. The pivoting handle extends radially outwardly to respective distal free ends of the first and second curvate locking jaws. An adjustable locking shaft is threadedly mounted within the rigid handle and extends radially inwardly thereof. A pair of elongated locking toggles are pivoted at a respective inner pivot end in the first curvate locking jaw and in the pivoting handle. Each locking toggle includes a free end extending radially outwardly and engaging the locking shaft within the locking handle. A plurality of support legs extend peripherally downwardly from the locking clamp. Each leg includes a floor engaging free end supported upon a threaded leveling shaft with a foot pad assembly.

1 Claim, 3 Drawing Sheets

STAND FOR SUPPORTING A CUT TREE TRUNK

CROSS-REFERENCE TO RELATED APPLICATIONS

None.

BACKGROUND OF THE INVENTION

The present invention relates to a portable stand for supporting a cut tree, such as a Christmas tree in a vertical position. The clamp is characterized by its horizontal and vertical adjustability. The horizontal adjustability enables the clamp to secure tree trunks of varying diameter and the vertical adjustability enables a leveling of the four legs of the device, as it supports the tree.

| 1. The Prior Art: | |
|---|---|
| KIRSHNER | 1,662,579 |
| HAMEL | 2,869,812 |
| LEATHERMAN | 3,295,802 |
| ABLET | 3,787,015 |
| ALIMENT et al. | 4,088,294 |
| WEIGAND | 4,611,781 |
| KARLEWSKI | 4,778,140 |
| STERLING | 4,989,820 |
| BROWN | 5,337,990 |
| LESEBURG et al. | 5,351,585 |
| ROY | 5,375,808 |
| SHULTZ | 5,407,168 |
| BEHRINGER | 5,467,959 |

SUMMARY OF THE INVENTION

The present invention is characterized by an adjustable clamp including a pair of locking jaws pivoted to each other. A rigid handle is secured to one locking jaw and a pivoted handle is secured to the other locking jaw. A pair of locking toggles secured within the handles engage an adjustable locking shaft within the rigid handle to lock the clamping jaw around the tree trunk circumference. Both locking jaws include radially outwardly extending support legs, each leg including a free end supported upon a threaded shaft with a floor engaging a foot pad, such that the entire device and the supported tree may be manually leveled as it is installed. The clamp may be manually adjusted by the locking toggle to lock upon tree trunks of varying diameter.

DETAILED DESCRIPTION OF THE PREFERRED EMBODIMENTS

Figure 1:
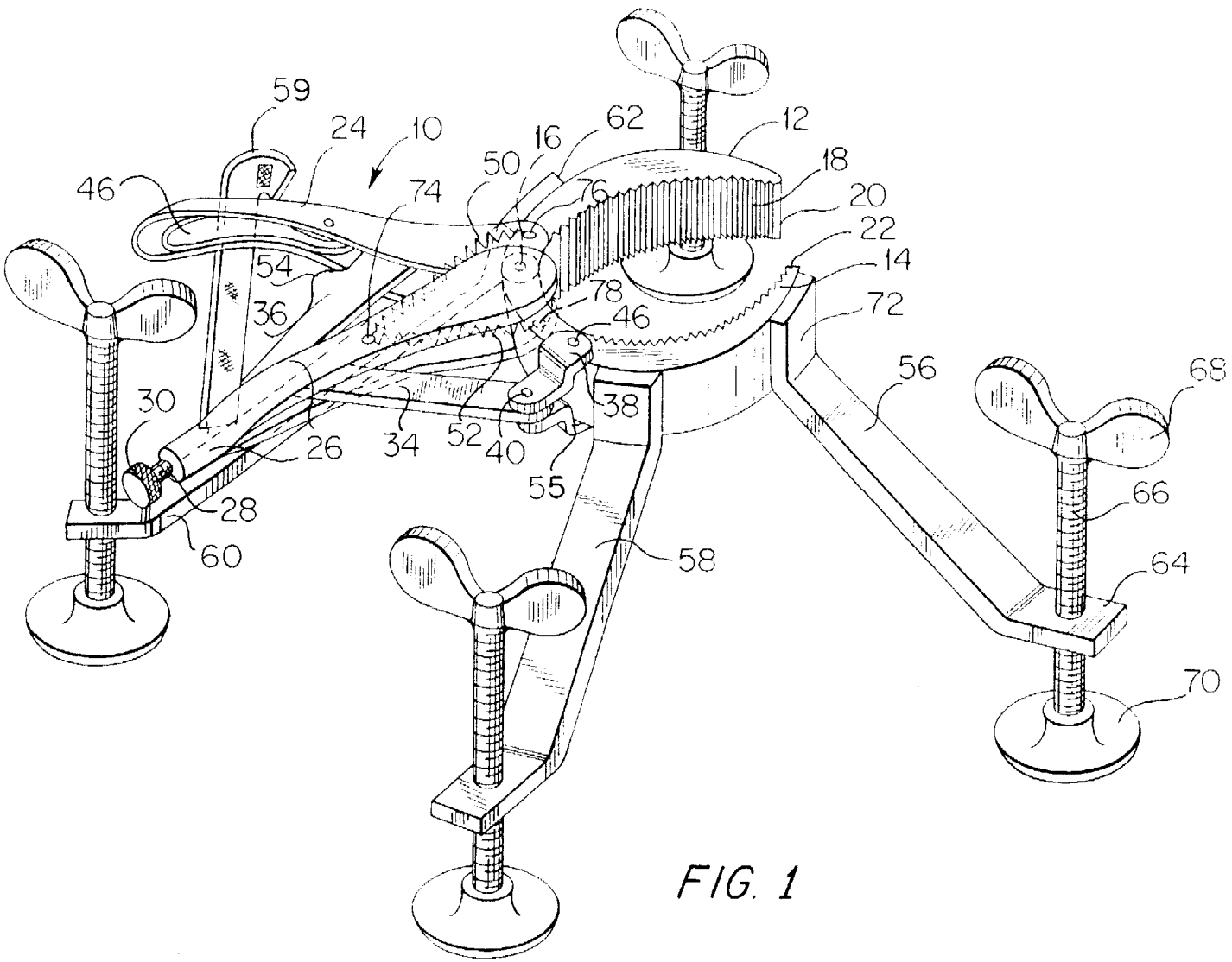
FIG. 1 is a perspective view of the device, including a first locking jaw and a second locking jaw, pivoted to each other at their base, so as to form an arcuate clamp.

As illustrated in FIG. 1, tree stand 10 includes curvate locking jaws 12, 14 pivoted at their joinder 16 and having vertical serrations 18 extending through the face of free ends 20, 22.

A fixed, locking handle 26 is secured by weldment, or the like, to locking jaw 14 such that locking jaw 12 may pivot through upper and lower surface 16. A pivoted handle 24 is pivoted to locking jaw 12 as at 76. A threaded and adjustable locking shaft 28 having a knurled adjusting knob 30 is shown extending inwardly of rigid handle 26 to engage the free ends of adjusting toggles 34, 36. An overcenter toggle linkage includes stub arm 36 with locking shoulder 54 which is pivoted in pivoting handle 24 such that its free end engages locking shaft 28 within rigid handle 26. A release lever 46 is pivoted in handle 24 so as to contact stub arm 36 at shoulder 54. Toggle 34 may be pivoted to lugs 38, 55 as at point 40, the lugs being secured to locking jaw 14 by conventional means 46.

Tension springs 50, 52 extend respectively, from base pin 74 within rigid handle 26 to independent pins 76, 78, respectively, within locking jaw 12 and locking jaw 14 so as to urge apart the locking jaws.

Figure 2:
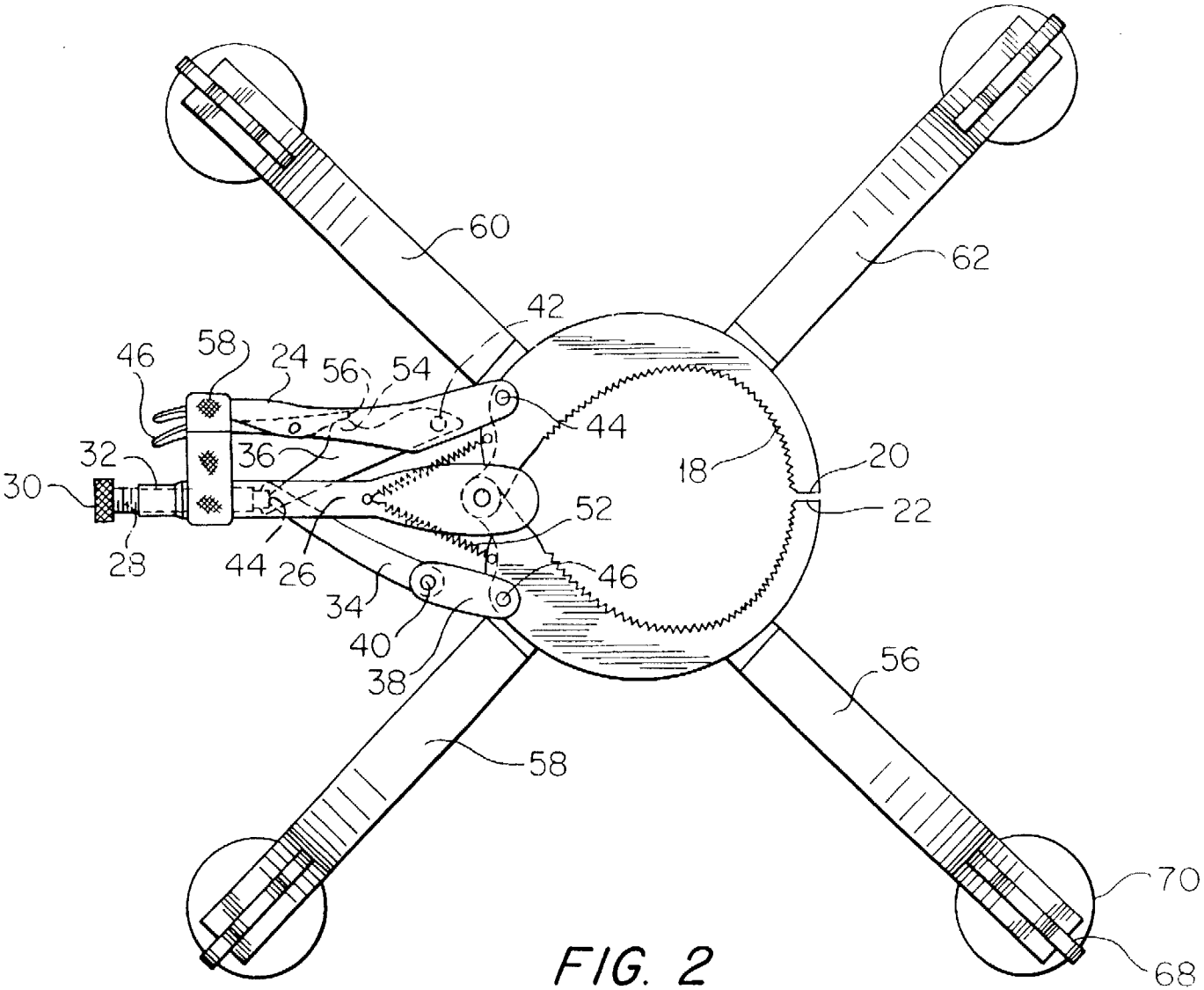
FIG. 2 is a top plan.
Figure 3:
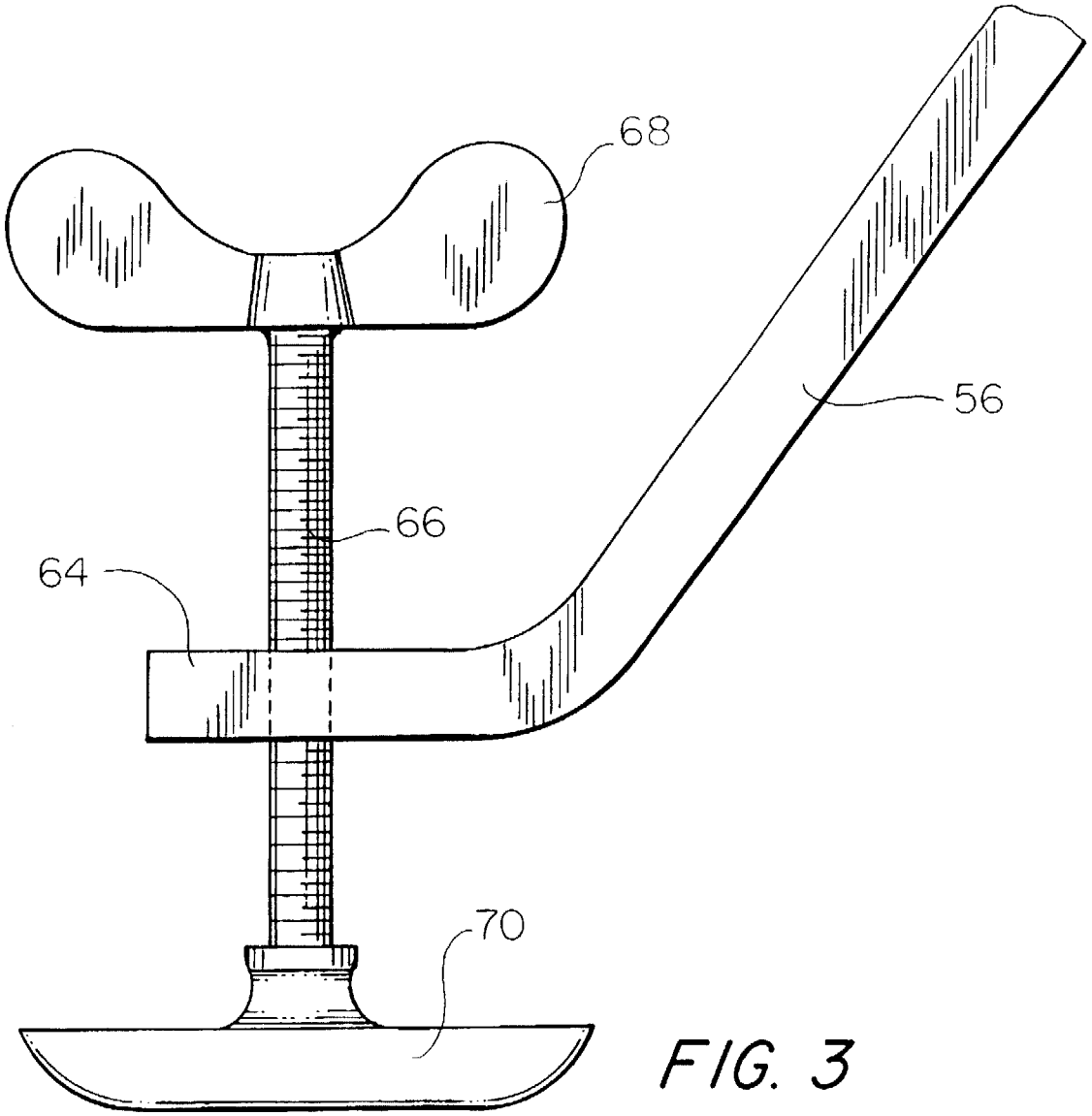
FIG. 3 is an enlarged, fragmentary side elevation of the downwardly extending legs having a threaded adjusting shaft and foot pad.

As illustrated in FIG. 2, the individual downwardly and outwardly extending legs 56, 58, 60 and 62 may include threaded adjusting shafts 66 with wing nut 68 and identical floor engaging pads 70.

A flexible or resilient locking strap 59 with VELCRO®-type securement may be employed to secure the pivoted handle 24 in its locked position adjacent handle 26.

As the tree is positioned within jaws 12, 14, threaded shaft 28 is used to adjust the locking compression of locking jaws 12, 14. As the tree trunk is secured by locking jaws 12, 14, VELCRO®-type safety strap 59 is wrapped around the handles 24, 26 to assure that the tree may not be disengaged from the tree base. As the tree is supported, a water bowl may be placed underneath the free end of the trunk and fine vertical adjustments made by leveling legs 56, 58, 60 and 62.

As it is desired to remove the tree from the stand, safety strap 59 is released and the locking release lever 46 is released to remove toggle 36 from engagement with threaded shaft 28. As will be apparent, the tree stand can be simply and securely fitted to the tree trunk without the use of additional tools such as a screwdriver. The gripping action of the jaws enables the device to be fitted securely into the tree base and the device is readily removed from the locking mechanism by release of the safety strap and handle. The outward extension of threaded adjusting shafts 66 enables leveling of the tree away from the center of the unit and eliminates the necessity for loosening the jaws to adjust leg heights.

Manifestly, variations in the dimensions of the parts may be employed without departing from the spirit of the invention.

I claim:

1. A stand for supporting a cut tree trunk in vertical position comprising:

a. a tree trunk encircling clamp, further including:

i. a first curvate locking jaw and a second curvate locking jaw each having a free end and a base end, said base ends pivotally connected to each other at a base, said locking jaws having a serrated inner surface convexly curvate in a radially inward direction facing each other and being adapted for closure with a tree trunk;

ii. a locking clamp including a rigid handle fixedly secured to the base end of said first locking jaw and a pivoting handle pivotally secured to said second pivoted jaw adjacent the base end thereof, said rigid handle and said pivoting handle extending radially outward to respective distal free ends of said first and second curvate locking jaws;

iii. an adjustable locking shaft threadedly mounted within said rigid handle and extending radially inwardly thereof;

iv. a pair of elongated locking toggles pivoted at a respective inner pivot end in said first curvate locking jaw and in said pivoting handle, each locking toggle having a free end extending radially outwardly and engaging said locking shaft within said locking handle, a first of said locking toggles being pivoted within said pivoting handle and including a locking shoulder at its mid-portion to engage said pivoting handle when said pivoting handle and said locking clamp are compressed together, a second of said locking toggles being supported within said rigid handle and engaging said adjustable locking shaft at its outer free end and at its inner pivot end being pivoted upon a lug secured to said first locking jaw;

v. a release lever pivoted at one end within said pivoting handle with a free end engaging the locking shoulder of said locking toggle pivoted within said pivoting handle, b. resilient means releasably securing the free ends of said pivoting handle and said rigid handle together, and c. a plurality of support legs extending peripherally downwardly from said locking clamp, each leg including a floor engaging free end supported upon a threaded leveling shaft and having a foot pad assembly, said support legs fixed to and extending from the free end and the pivoted end of each said locking jaw, at least two support legs extending from each said locking jaw.

* * * * *